US005135150A

United States Patent [19]

Chun

[11] Patent Number: 5,135,150

[45] Date of Patent: Aug. 4, 1992

[54] POLE-TYPE POWDER ACTUATED TOOL

[76] Inventor: Wang T. Chun, P.O. Box 82-144, Taipei, Taiwan

[21] Appl. No.: 636,621

[22] Filed: Jan. 2, 1991

[51] Int. Cl.[5] ..... B25C 1/10

[52] U.S. Cl. ..... 227/9

[58] Field of Search ..... 227/9, 10, 11, 55, 146

[56] References Cited

U.S. PATENT DOCUMENTS

| | | | |
|---|---|---|---|
| 2,166,041 | 7/1939 | Cox | 227/9 |
| 2,479,431 | 8/1949 | Temple | 227/9 |
| 2,549,993 | 4/1951 | Temple | 227/11 |
| 2,771,607 | 11/1956 | Skumawitz | 227/9 |
| 2,775,762 | 1/1957 | Hilti | 227/11 |
| 3,797,721 | 3/1974 | Clumb | 227/9 |
| 4,505,018 | 3/1985 | Regalbuto et al. | 227/9 |
| 4,877,171 | 10/1989 | Almeras | 227/9 |

*Primary Examiner*—Douglas D. Watts
*Assistant Examiner*—Scott A. Smith
*Attorney, Agent, or Firm*—Alfred Lei

[57] ABSTRACT

This invention relates to a pole-type powder actuated tool and in particular to one mainly including a first pin having a flange at the top end and being able to be pushed by a shell withdrawing mechanism, a second pin having a flange at the top end in contact with the flange of the first pin so that the second pin will move in unison with the first pin, a front barrel for receiving drive pin and cartridge and provided with threads at one end thereof, a rear barrel for accomodating the second pin wholly and a part of the first pin and threadedly engaged with the front barrel at one end and with a connecting pipe at the other, two springs enclosing the first pin and second pin for forcing the two pins to the normal position after fired, and a gasket disposed between the front barrel and the rear barrel and being able to adjust volume of explosion chamber by modifying its thickness.

2 Claims, 1 Drawing Sheet

POLE-TYPE POWDER ACTUATED TOOL

BACKGROUND OF THE INVENTION

It is found that the conventional P. A. T. (powder actuated tool) utilizes a trigger and a firing pin to actuate explosion thereby pushing a piston rod and striking a drive pin into a workpiece from the tool. However, such powder actuated tool is complicated in structure and often has trouble. Then a powder actuated tool without trigger, firing pin and piston has been developed to eliminate such drawbacks. Nevertheless, the withdrawing pin thereof is easily broken and the explosion force cannot be controlled to adapt to various kinds of working pieces.

Therefore, it is an object of the present invention to provide a powder actuated tool which may obviate and mitigate the above-mentioned drawbacks.

SUMMARY OF THE INVENTION

This invention relates to an improvement in a powder actuated tool.

It is the primary object of the present invention to provide a powder actuated tool having a shell withdrawing mechanism which may steady the shell withdrawing operation.

It is another object of the present invention to provide a powder actuated tool which is durable in use.

It is still another object of the present invention to provide a powder actuated tool which controls the striking force of the drive pin by adjusting the volume of the explosion chamber.

It is a further object of the present invention to provide a powder actuated tool which is lightweight, compact, and easy to operate.

Other objects and merits and a fuller understanding of the present invention will be obtained by those having ordinary skill in the art when the following detailed description of the preferred embodiment is read in conjunction with the accompanying drawings.

DETAILED DESCRIPTION OF THE PREFERRED EMBODIMENT

Figure 1:
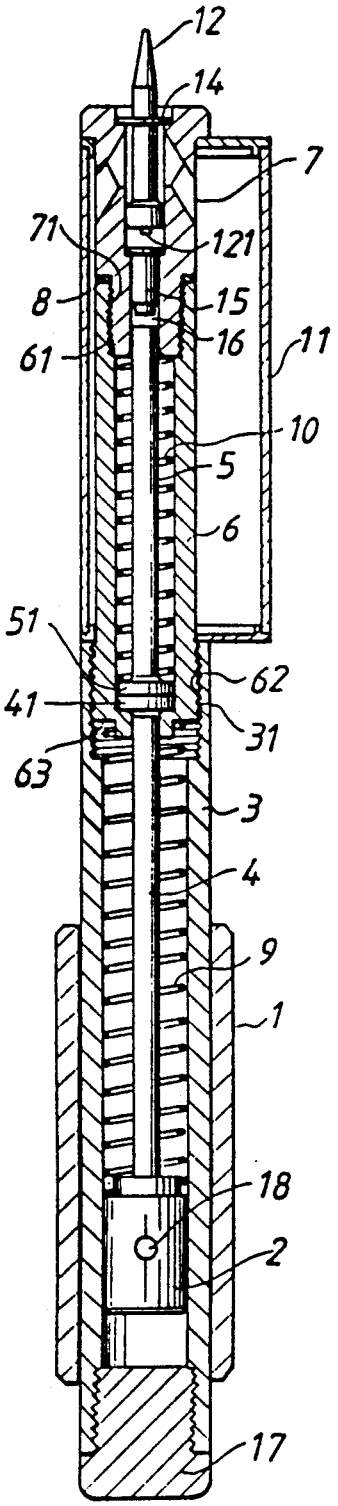
FIG. 1 is a sectional view of the present invention already loaded with pin and cartridge and ready to fire.

With reference to the drawings and in particular to FIG. 1 thereof, the pole-type powder actuated tool according to the present invention mainly comprises a first pin 4, a second pin 5, springs 9 and 10, a front barrel 7, a rear barrel 6 and a gasket 8.

The first pin 4 and the second pin 5 are cylindrical in shape and respectively have flanges 41 and 51 the bottom surfaces of which are provided with rounds. The rear barrel 6 is a tubular member with threads 61 and 62 at both ends. If 61 is internal threads, then 62 is external threads, and vice versa. The front barrel 7 is provided at one end with external threads 71 which are engageable with internal threads 61 at the end of the rear barrel 6. The front barrel 7 further has a chamber for receiving a drive pin 12, a cartridge 15 and the second pin 5 between which is formed an explosion chamber.

As the powder actuated tool suitable for use with the present invention is not provided with trigger and piston rod, a protuberance of the drive pin 12 will impact the cartridge 15 thereby producing an exploding force to push the drive pin 12 into the working piece. The dust produced in explosion is collected by a rubber member (not shown) so that it will not scatter everywhere. In use, a metal washer 14 is used to guide the striking direction so as to prevent excess penetration. When in shell withdrawal, the shell will be pushed out of the sleeve 1 to rotate rightwards thus moving a pin 18 into a slot 30 of a connecting pipe 3 (see FIG. 2) and causing a pusher 2 and the sleeve 1 to move at the same time. Hence, it is only necessary to push the sleeve 1 forward in order to push the pins 4 and 5 forward thereby withdrawing the shell of the cartridge 15 out of the powder actuated tool.

Looking now at FIG. 1, the first pin 4 is disposed within the connecting pipe 3 and is enclosed with a recovering spring 9. The spring 9 bears against the pusher 2 at one end and is fixedly connected at the other end with a bearing member 63 at the end of the rear barrel 6. Further, one end of the first pin 4 is disposed within the rear barrel 6 as shown in the drawings. In addition, the rear barrel 6 is threadedly engaged with the internal threads 31 of the connecting pipe 3 via its external threads 62. The other end of the rear barrel 6 is threadedly engaged with the external threads 71 of the front barrel 7 via its internal threads 61. The flange 51 of the second pin 5 is in contact with the flange 41 of the first pin 4. The second pin 5 is also enclosed with a recovering spring 10 which bears against the flange 51 at one end and against an end surface of the front barrel 7 at the other. Between the front barrel 7 and the rear barrel 6 there is a gasket 8 which is designed for preventing air after explosion from leaking outside thereby providing an effective sealing. Also, it is possible to change the gasket 8 with one of different thickness to adjust the engagement between the front barrel 7 and the rear barrel 6. Hence, an explosion chamber 16 between the cartridge 15 and the second pin 5 may be modified in volume to control the explosion power of the cartridge.

Figure 2:
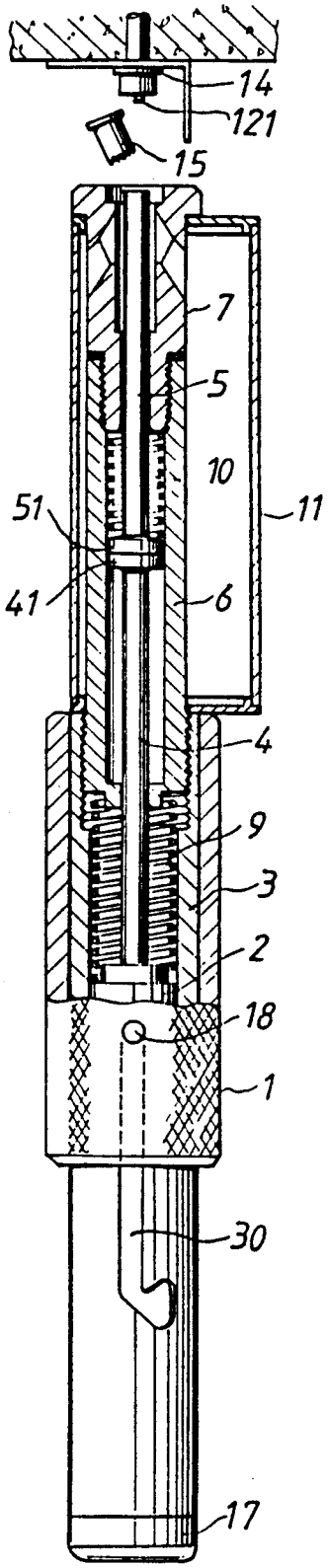
FIG. 2 is a sectional view of the present invention already fired and utilizing the withdrawing pin to eject the shell out.

FIG. 2 is a sectional view of the present invention with the cartridge already fired and utilizing the withdrawing pin to eject the shell out. As mentioned above, the sleeve 1 is pushed upwards and rotated rightwards thereby disposing the pin 18 within the slot 30 of the connecting pipe 3 so that the pusher 2 and the sleeve 1 may move altogether. In the meantime, the recovering springs 9 and 10 are in compressed condition and tend to go backwards. Thus, the first pin 4 will push the second pin 5 forward thereby withdrawing the shell of the cartridge 15. The flanges 41 and 51 are used for keeping the function steady when subjected to impact and are tightly fitted with the wall of the rear barrel 6 so as to prevent air leakage. In addition, the bottom surfaces of the flanges 41 and 51 are provided with rounds to prevent air leakage so that when no force exerts on the sleeve 1, the springs 9 and 10 may return the pins 4 and 5 to their original positions.

Figure 3:
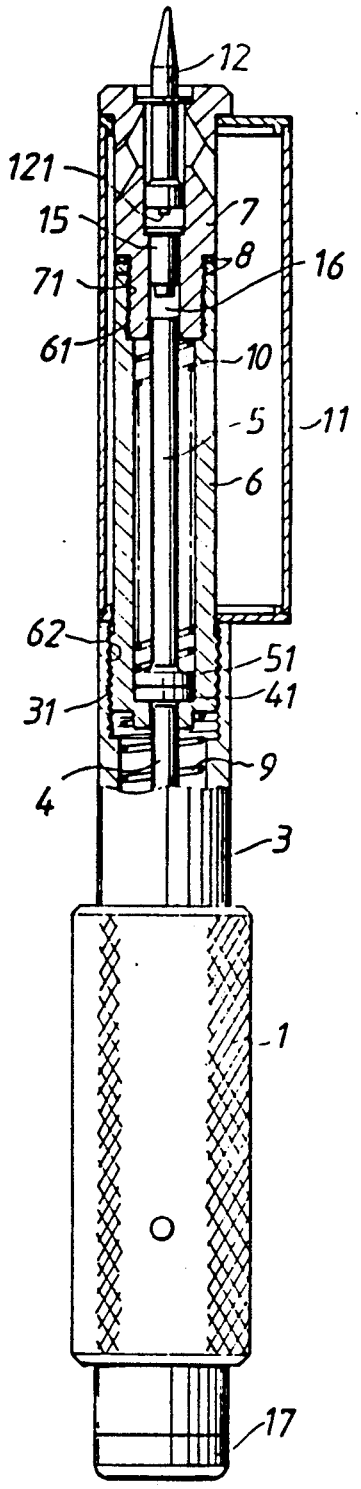
FIG. 3 is a sectional view illustrating the principle of enlarging the explosion chamber of the present invention.

FIG. 3 is a sectional view illustrating the principle of enlarging the explosion chamber of the present invention. When desired to adjust the volume of the explosion chamber 16, simply dismantle the front barrel 7 and increase the number of gasket 8 (i.e. increasing the thickness of the gasket). Hence, when the front barrel 7 is threadedly engaged with the rear barrel 6, the explosion chamber 16 will be enlarged in space and so the explosion force of the cartridge 15 will be decreased thereby achieving the purpose of controlling the striking force.

In conclusion, the powder actuated tool according to the present invention may be controlled in explosion force by adjusting the volume of the explosion chamber thereby adapting to various working needs. Moreover, the shell withdrawal mechanism may increase the durability of the powder actuated tool.

although the present invention is described with a certain degree of particularity, it is understood that the present disclosure is made by way of example only and that numerous changes in the detail of construction and the combination and arrangements of parts may be resorted to without departing from the spirit and scope of the invention as hereinafter claimed.

I claim:

1. A pole-type powder actuated tool comprising:

a first pin, cylindrical in shape, having a flange at a top end and being able to be pushed by a shell withdrawing mechanism;

a second pin also cylindrical in shape and having a flange at a bottom end in contact with the flange of said first pin so that said second pin may move in unison with said first pin;

a front barrel for receiving drive pin and cartridge and provided with threads at one end thereof;

a rear barrel for accommodating said second pin wholly and a part of said first pin, said rear barrel being provided with a first threaded portion at one end for engaging with said front barrel and a second threaded portion at the other end for engaging with a housing of said first pin;

two springs enclosing said first pin and second pin respectively; and an explosion chamber having an adjustable volume, said volume being adjustable by selecting a gasket having a desired thickness, said gasket placed between said front barrel and said second barrel.

2. The pole-type powder actuated tool as claimed in claim 1, wherein the flanges of said first and second pins are provided with rounds.

* * * * *